US005567251A

United States Patent [19]

Peker et al.

[11] Patent Number: 5,567,251

[45] Date of Patent: Oct. 22, 1996

[54] AMORPHOUS METAL/REINFORCEMENT COMPOSITE MATERIAL

[75] Inventors: Atakan Peker; William L. Johnson, both of Pasadena, Calif.; Robert Schafer, Worthington, Ohio; David M. Scruggs, Oceanside, Calif.

[73] Assignee: Amorphous Alloys Corp., Laguna Niguel, Calif.

[21] Appl. No.: 417,749

[22] Filed: Apr. 6, 1995

Related U.S. Application Data

[63] Continuation-in-part of Ser. No. 284,153, Aug. 1, 1994.

[51] Int. Cl.[6] ..... C22C 9/00

[52] U.S. Cl. ..... 148/522; 148/561; 148/563

[58] Field of Search ..... 148/522, 563, 148/561

[56] References Cited

U.S. PATENT DOCUMENTS

| | | | |
|---|---|---|---|
| 4,268,564 | 5/1981 | Narasimhan | 428/143 |
| 4,960,643 | 10/1990 | Lemelson | 428/408 |
| 5,288,344 | 2/1994 | Peker et al. | 148/403 |
| 5,380,349 | 1/1995 | Taniguchi et al. | 65/286 |

OTHER PUBLICATIONS

T. Masumoto, "Recent progress in amorphous materials in Japan," *Materials Science and Engineering*, vol. A179/A180, pp. 8–16 (1994).

American Society for Metals, Metals Handbook, Ninth Edition, vol. 3: "Superhard Tool Materials", pp. 448–465 (1980).

*Primary Examiner*—A. A. Turner

*Attorney, Agent, or Firm*—Gregory Garmong

[57] ABSTRACT

A reinforcement-containing metal-matrix composite material is formed by dispersing pieces of reinforcement material throughout a melt of a bulk-solidifying amorphous metal and solidifying the mixture at a sufficiently high rate that the solid metal matrix is amorphous. Dispersing is typically accomplished either by melting the metal and mixing the pieces of reinforcement material into the melt, or by providing a mass of pieces of the reinforcement material and infiltration of the molten amorphous metal into the mass. The metal preferably has a composition of about that of a eutectic composition, and most preferably has a composition, in atomic percent, of from about 45 to about 67 percent total of zirconium plus titanium, from about 10 to about 35 percent beryllium, and from about 10 to about 38 percent total of copper plus nickel.

13 Claims, 3 Drawing Sheets

AMORPHOUS METAL/REINFORCEMENT COMPOSITE MATERIAL

This application is a continuation-in-part of application Ser. No. 08/284,153, filed Aug. 1, 1994, for which priority is claimed now allowed.

BACKGROUND OF THE INVENTION

This invention relates to a composite material having reinforcement material, desirably particles of refractory ceramics, bonded into an amorphous metal matrix.

Hard, abrasive materials such as certain carbides, borides, and nitrides are widely used to cut other, softer materials such as metals. Large single pieces of these hard, abrasive materials are too brittle and too expensive for many cutting-tool applications.

A bonded-tool technology has developed over the years for using smaller pieces of such materials in cutting tools. In this approach, small particles of the hard, abrasive material are bonded at elevated temperatures into a matrix of a metal such as a nickel or cobalt alloy by liquid phase sintering. This process requires considerable exposure time of the components at highly elevated temperatures. Upon cooling, the resulting composite material has the particles of the hard, abrasive material dispersed throughout the metal matrix. The metal matrix bonds the particles together and also imparts fracture toughness and provides thermal conductivity to the article. As one example of this type of material, tungsten carbide/cobalt alloy cutting tools are widely used commercially.

The extended contact between the abrasive material and the molten metal during their extended contact at highly elevated temperatures can lead to chemical interactions between the particles and the molten metal, especially in the presence of reactive alloy additions to the matrix material. The chemical reactions may result in the formation of brittle intermetallic reaction products at the particle/matrix interface or within the matrix. After cooling, the reaction products may adversely affect the properties of the composite material. One solution to the problem is to coat the particles with a reaction-inhibiting coating, but such coatings are typically expensive to apply and often have limited effectiveness. Accordingly, the range of choices for the matrix material is sometimes severely limited to avoid the presence of reactive constituents. The matrix may consequently be relatively soft, weak, and susceptible to corrosion damage.

When a composite material of this type is used as a cutting tool, the surface regions of the metal matrix quickly wear away to expose the pieces of the hard, abrasive material. This exposed region acts as the cutting instrument, inasmuch as it is hard, abrasive, durable, and resistant to wear during the cutting operation. However, the underlying metal matrix which bonds the hard, abrasive material can wear away or crack with extended use and/or exposure to corrosive media. These problems are particularly troubling for those cases where there are reaction products in the matrix or the matrix was chosen to be relatively soft and weak in order to avoid the presence of reaction products. In these cases, the cutting tool may prematurely fail as the matrix material is removed or damaged, and the bonded abrasive material is undermined.

Accordingly, there is a need for an improved bonded composite material of reinforcement particles, particularly refractory ceramic particles, distributed in a matrix. Such an improved material would find immediate use in cutting tools, and also in other applications such as hard facings and structures having a high strength-to-weight ratio. The present invention fulfills this need, and provides related advantages.

SUMMARY OF THE INVENTION

This invention provides a metal-matrix composite material having reinforcement materials bonded together by an amorphous-metal matrix, and a method for preparing the composite material. A wide range of types of reinforcement materials can be used. In a preferred approach, a bulk-solidifying amorphous material is employed, permitting the preparation of large, tool-sized pieces of the composite material rather than thin ribbons.

In accordance with the invention, a method of forming a reinforcement-containing metal-matrix composite mate rial comprises the steps of providing a metal having a capability of retaining the amorphous state when cooled from its melt at a critical cooling rate of no more than about 500° C. per second, and providing at least one piece of reinforcement material which is initially separate from the metal. The method further includes melting the metal and dispersing the at least one piece of reinforcement material throughout the melt to form a mixture, and solidifying the mixture at a cooling rate no less than the critical cooling rate.

More preferably the method involves the use of a plurality of pieces of the reinforcement material. The reinforcement pieces, also termed particles, can be generally equiaxed or elongated in the manner of fibers. The step of dispersing is desirably accomplished either by preparing a mass of molten metal in a crucible and mixing the pieces of the reinforcement material into the mass of molten metal, or by preparing a mass of pieces of the reinforcement material, melting the metal, and infiltrating the melted metal into the mass of pieces of the reinforcement material.

The reinforcements are most preferably refractory ceramics having melting points at least about 600° C. above the melting point of the amorphous metal matrix and also having excellent stability, strength, and hardness. Examples of these refractory ceramics useful as reinforcements include stable oxides, stable carbides, and stable nitrides.

The metal-matrix material is a bulk-solidifying amorphous material in which the amorphous state can be retained in cooling from the melt at a rate of no greater than about 500° C. per second. The metal-matrix material should have a melting point at least about 600° C., preferably more, below the melting point of the refractory material. A preferred such metal-matrix material has a composition near a eutectic composition, such as a deep eutectic composition with a eutectic temperature on the order of 660° C. On such material has a composition, in atom percent, of from about 45 to about 67 percent total of zirconium plus titanium, from about 10 to about 35 percent beryllium, and from about 10 to about 38 percent total of copper plus nickel, plus incidental impurities adding to a total of 100 atom percent. Certain substitutions can be made in this composition, as will be discussed subsequently.

Due to the high surface energy and low melting point of the bulk amorphous alloy, the various types of reinforcements are readily wet by the molten amorphous alloy. The composite is thus formed at a relatively low temperature without significant degradation of the reinforcement and, surprisingly, without substantial crystallization of the matrix alloy.

One important problem arising with most composite materials fabricated at elevated temperatures is internal thermal strains and stresses created as a result of the differing thermal expansion coefficients of the reinforcement and the matrix phases. High thermal strains and stresses in the final solid composite material can lead to debonding of the reinforcement from the matrix and degradation of composite properties during service. In the present case, thermal strains arising from differential thermal expansion are avoided as long as the matrix material is above its glass transition temperature and flows to negate the effects of the differing coefficients of thermal expansion, and are in any event minimized due to the relatively small difference in thermal expansion coefficients of the bulk-solidifying amorphous matrix alloy and the ceramic reinforcement. As the composite is cooled below the glass transition temperature of the amorphous matrix material, the matrix can no longer flow in a glassy manner and thermal strains and stresses accumulate. However, because the glass transition temperature is relatively low, about 350° C. for the preferred matrix material, such thermal strains and stresses are much less severe than in conventional composite materials. A further important factor in minimizing thermal strains and stresses in the composite material is the absence of an abrupt phase change in the amorphous matrix material, as is found in conventional crystalline matrix materials as they cool from the molten to the solid state.

In the composite material of the invention, the amorphous-metal matrix bonds the reinforcement particles together. The particles are not degraded during fabrication due to the low melting point and composition of the matrix material and therefore can attain their full potential in a cutting tool. Moreover, the amorphous matrix itself is hard and strong so that it does not degrade or rapidly wear away during service, yet is reasonably ductile and fracture resistant. The composite material is therefore operable as a cutting tool that is hard yet resistant to failure. The amorphous material is also highly corrosion resistant, because it has no internal grain boundaries to serve as preferential sites for the initiation of corrosion. Corrosion resistance is desirable, because it may be expected that the composite materials of the invention may be exposed to corrosive environments during service. For example, cutting tools are often used with coolants and lubricants that may cause corrosion.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
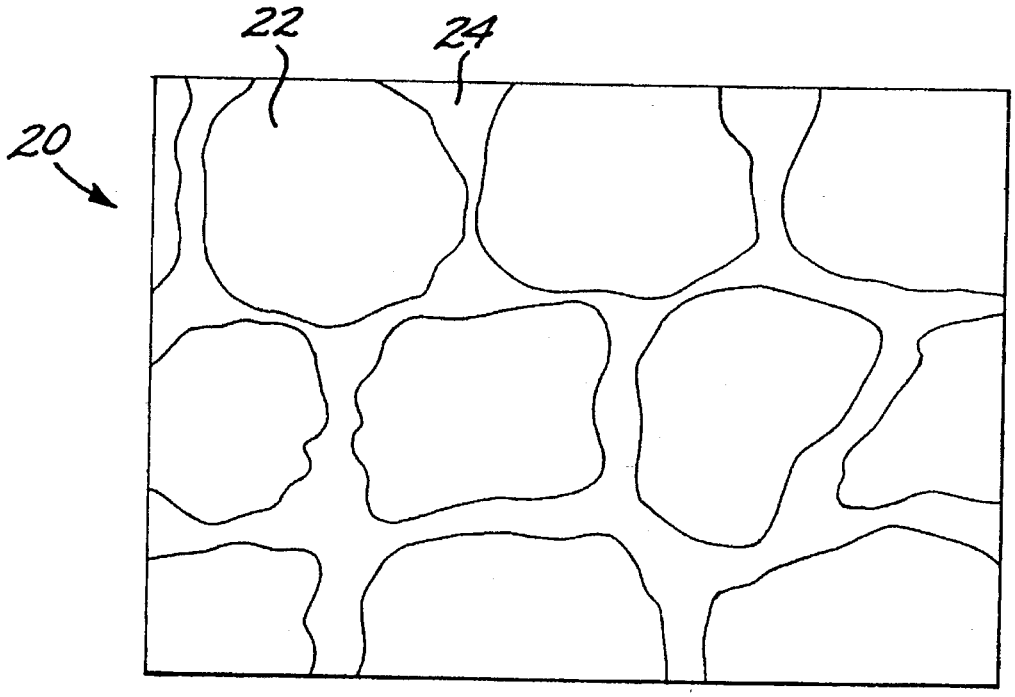
FIG. 1 is a drawing of the microstructure of the material of the invention.

FIG. 1 illustrates an idealized microstructure of a composite material 20 made by the present approach. The composite material 20 is a mixture of two phases, a reinforcement phase 22 and a metal-matrix phase 24 that surrounds and bonds the reinforcement phase 22.

In an embodiment of the invention wherein a substantially uniform array of reinforcement particle phase within the metal-matrix phase is attained, the reinforcement phase 22 desirably occupies from about 50 to about 90 volume percent of the total of the reinforcement phase and the metal-matrix phase, although phase percentages outside this range are operable. If the reinforcement phase is present in a smaller volume percent, it becomes progressively more difficult, as the amount of reinforcement phase is reduced, to prepare a uniform dispersion of the reinforcement phase within the metal-matrix phase using the preferred melt-fabrication technique. The composite also will have insufficient hardness for cutting tool applications. If the reinforcement phase is present in a higher volume percent, it is difficult to form a homogeneous mixture with matrix phase surrounding and wetting the reinforcement particles. Additionally, the composite material will have an un acceptably low fracture resistance. In a most preferred form of this embodiment, the reinforcement phase occupies from about 70 to about 85 volume percent of the total material. This embodiment is desirably used for cutting tools and the like.

In another embodiment, a smaller volume percent of reinforcement is present in a composite material in which the reinforcement phase is concentrated at the surface of the material. It has been observed that, for low volume percentages of reinforcement present in the composite material, the reinforcement particles preferentially segregate to the surface of the composite material as the matrix phase is cooled and becomes increasingly viscous. This form of the invention can utilize much smaller volume percentages of reinforcement in the composite material, and is particularly valuable when the final material is to be used for applications such as surface finishing or polishing.

Figure 2:
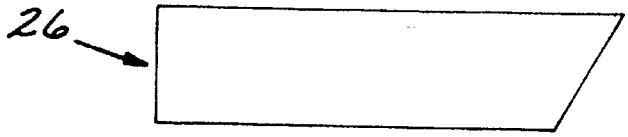
FIG. 2 is an elevational view of a first type of cutting tool made using the material of the invention.
Figure 3:
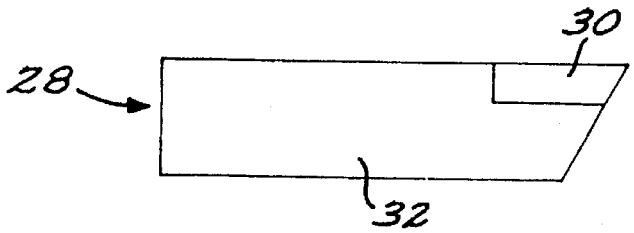
FIG. 3 is an elevational view of a second type of cutting tool made using the material of the invention.

FIGS. 2 and 3 illustrate cutting tools made of the material of the invention, as shown in FIG. 1. These depicted cutting tools are presented as illustrations, and other geometries can be prepared, such as drills, milling cutters, cutting blades, and cutting wheels, for example. The cutting tool 26 of FIG. 2 is made entirely of the composite material 20. Alternatively, the cutting tool 28 of FIG. 3 has only a cutting insert 30 made of the composite material 20. The cutting insert 30 is bonded or affixed to a tool support 32 made of steel or other inexpensive material.

Figure 4:
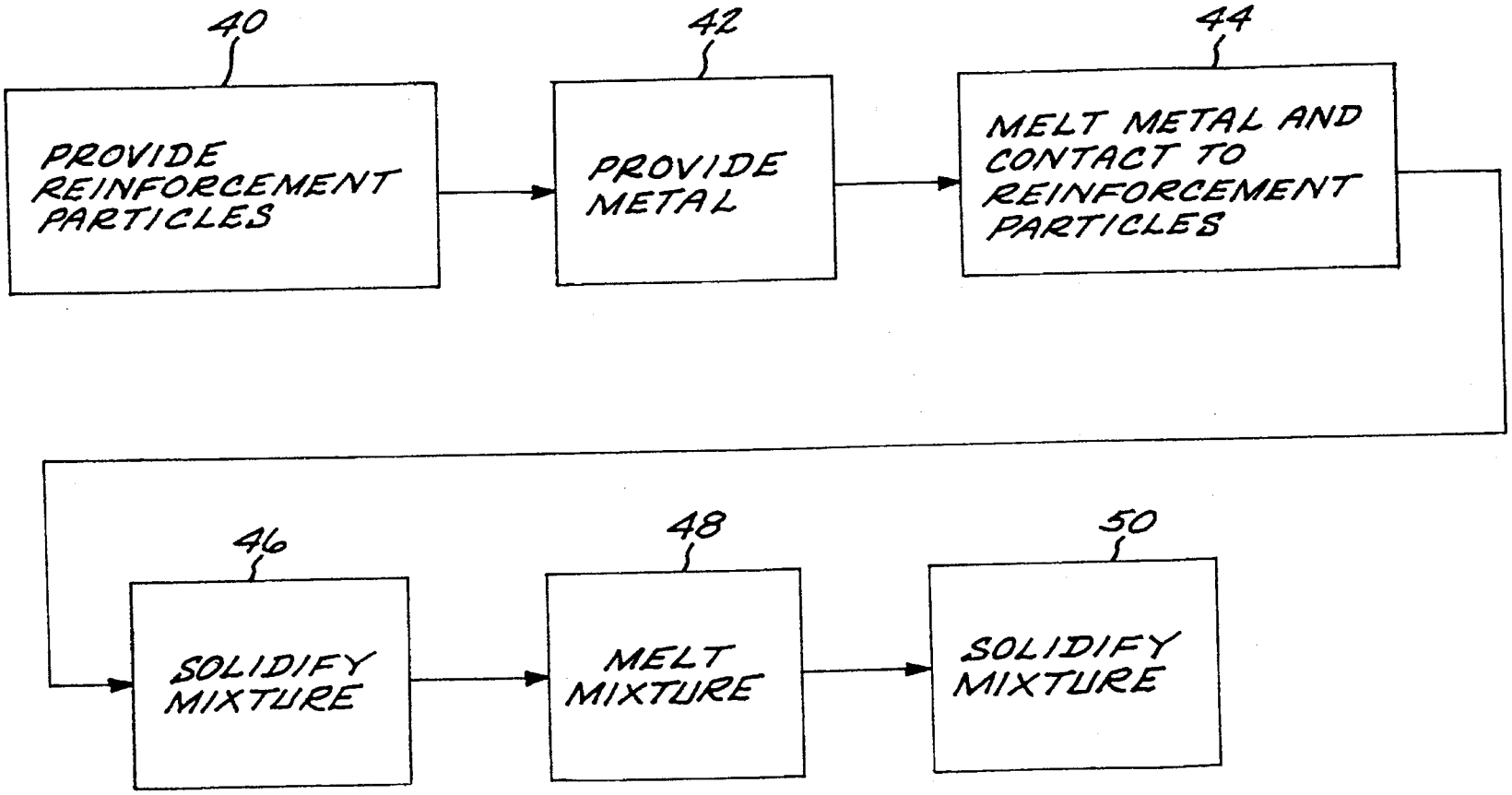
FIG. 4 is a flow diagram for a preferred approach to preparing the material of FIG. 1.

FIG. 4 illustrates a method for fabricating pieces of the composite material 20 and/or articles made of the composite material 20. Reinforcement particles are first provided, numeral 40. The reinforcement particles are preferably of a size of from about 20 to about 160 mesh for use in cutting, drilling, grinding, and comparable applications. The reinforcement particles are preferably smaller than this range for use in polishing applications. For cutting and polishing applications, the reinforcement particles are typically not perfectly regular in shape, but are generally equiaxed and irregularly shaped, as shown in FIG. 1. The indicated dimension is an approximate maximum dimension of the particles. Most preferably, the reinforcement particles are from about 20 to about 80 mesh in size for cutting applications. The reinforcement phase can also be elongated in one dimension as a fiber or in two dimensions as a platelet.

Any type of reinforcement that is chemically stable in the fabrication processing can be used. The reinforcement is most preferably a refractory ceramic. Examples of suitable reinforcements include stable oxides such as alumina, zirconia, beryllia, and silica stable carbides such as carbides of tantalum, titanium, niobium, zirconium, tungsten, chromium, and silicon; and stable nitrides such as cubic boron nitride and the nitrides of silicon, aluminum, zirconium, and titanium. This listing is not exhaustive, and is presented by way of example.

The reinforcement should have a melting point (which term includes "softening point" where applicable) at least about 600° C. above the melting point of the matrix alloy. If the melting point of the reinforcement is less than about 600° C. above the melting point of the matrix alloy, there is a much greater likelihood of chemical reactions between the reinforcement and the matrix alloy, and also that the matrix alloy will crystallize upon cooling of the composite material.

The matrix material is provided, numeral 42. The matrix material is a metal alloy, termed herein a "bulk solidifying amorphous metal", that can be cooled from the melt to retain the amorphous form in the solid state at relatively low cooling rates, on the order of 500° C. per second or less.

This ability to retain an amorphous structure even with a relatively slow cooling rate is to be contrasted with the behavior of other types of amorphous metals that require cooling rates of at least about $10^{4\circ}$–$10^{6\circ}$ C. per second from the melt to retain the amorphous structure upon cooling. Such metals can only be fabricated in amorphous form as thin ribbons or particles. The preparation of thin strips of such prior amorphous metals with reinforcements embedded in the top surface of the strip has been suggested previously, see U.S. Pat. No. 4,268,564. Such a form has limited usefulness in the preparation of cutting tools and the like, both because of the fabrication difficulties and also because the reinforcements are not dispersed throughout the volume of the article.

A preferred type of bulk-solidifying amorphous alloy has a composition of about that of a deep eutectic composition. Such a deep eutectic composition has a relatively low melting point and a steep liquidus. The composition of the bulk-solidifying amorphous alloy is therefore desirably selected such that the liquidus temperature of the amorphous alloy is no more than about 50° C. higher than the eutectic temperature, so as not to lose the advantages of the low eutectic melting point. Because of this low melting point, the melt-fabrication processing of the invention can be accomplished at a sufficiently low temperature that degradation of the reinforcement particles is minimized.

A preferred type of bulk-solidifying amorphous alloy has a composition near a eutectic composition, such as a deep eutectic composition with a eutectic temperature on the order of 660° C. This material has a composition, in atom percent, of from about 45 to about 67 percent total of zirconium plus titanium, from about 10 to about 35 percent beryllium, and from about 10 to about 38 percent total of copper plus nickel. Surprisingly, this high zirconium and titanium content reacts with typical reinforcement materials very slowly, probably because of the low temperatures that are used in the fabrication processing, and there is substantially no crystallization of the matrix alloy as it cools. A substantial amount of hafnium can be substituted for some of the zirconium and titanium, aluminum can be substituted for the beryllium in an amount up to about half of the beryllium present, and up to a few percent of iron, chromium, molybdenum, or cobalt can be substituted for some of the copper and nickel. A most preferred such metal-matrix material has a composition, in atomic percent, of about 41.2 percent zirconium, 13.8 percent titanium, 10 percent nickel, 12.5 percent copper, and 22.5 percent beryllium, and a melting point of about 670° C. This bulk-solidifying alloy is known and described in U.S. Pat. No. 5,288,344, whose disclosure is incorporated by reference.

Figure 5:
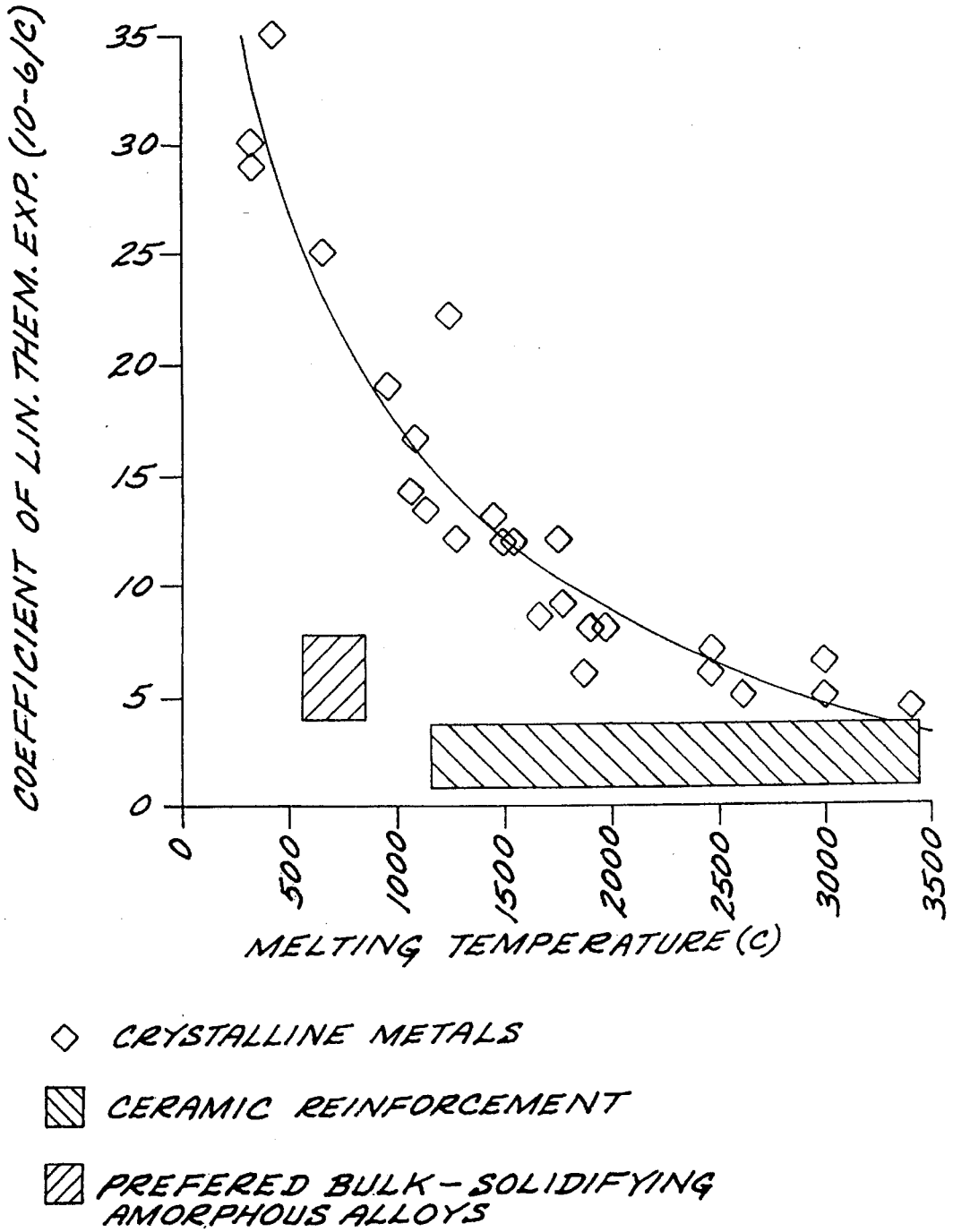
FIG. 5 is a graph of thermal expansion coefficient as a function of temperature for metals, ceramics, and the preferred bulk-solidifying matrix alloy.

Another important advantage to using a bulk-solidifying amorphous mate rial as the matrix of the composite material is illustrated in FIG. 5 for the case of the preferred amorphous matrix material. It is desirable to use a metal having a low melting point as the matrix of the composite material, so that melt fabrication can be accomplished at a relatively low temperature to avoid excessive chemical reaction with the reinforcement material. Conventional crystalline-solid metals which have a low melting point tend to have a high coefficient of thermal expansion, as shown in the curve of FIG. 5. Ceramic reinforcement materials of interest, on the other hand, tend to have a low coefficient of thermal expansion.

The large difference in thermal expansion between conventional crystalline metals and ceramics leads to large and undesirable internal strains and stresses which result as the composite is cooled from the melting point.

The inventors have recognized that the bulk-solidifying amorphous metals have a much lower coefficient of thermal expansion for their melting points than do the crystalline-solid metals. The coefficients of thermal expansion of the bulk-solidifying amorphous metals are much closer to those of the ceramics than are the coefficients of thermal expansion of the crystalline metals, resulting in much lower thermally induced strains and stresses in a composite material upon cooling to ambient temperature. These bulk-solidifying amorphous alloys are therefore desirably used as the matrix in composite materials.

Additionally, the total accumulated thermal strains and stresses depend upon the temperature change from the initiation of strain and stress buildup, in addition to the difference in thermal expansion coefficient of the components. For the case of a conventional crystalline-solid matrix, thermal strains and stresses begin building at just below the melting point of the metal as the composite is cooled. For the case of the bulk-solidifying amorphous metal matrix, thermal strains and stresses begin building at the glass transition temperature as the composite is cooled, because the metal exhibits glassy flow at higher temperatures to negate the thermal strains and stresses. In the case of the preferred matrix material, the melting point is about 670° C. but the glass transition temperature is about 250° C., over 300° C. lower.

Thus, the thermal strains and stresses induced in the composite material having a matrix of a bulk-solidifying amorphous material are much lower than those of a composite material having a conventional crystalline metal matrix for several reasons. One is that the difference in the coefficient of thermal expansion of the bulk-solidifying amorphous alloy is close to that of the ceramic reinforcement. A second is that the thermal strains and stresses do not begin to build until the composite cools below the glass transition temperature of the matrix alloy. A third is that the amorphous metals do not exhibit an abrupt phase change at the melting point.

The bulk-solidifying alloy is melted, and the reinforcement particles are dispersed in the melt, numeral 44. In this context, "dispersed" can mean either that the reinforcement particles are mixed into a volume of the molten metal or that the melt is infiltrated into a mass of the reinforcement particles. In either case, the final composite has reinforcement particles distributed throughout the volume of the matrix material.

When the volume percent of reinforcement particles is relatively smaller compared to the volume percent of metal, the reinforcements can be stirred into the melt. When the volume percent of reinforcement particles is relatively larger compared to the volume percent of metal or the reinforcement particles are fibrous with a high aspect ratio or are woven together, the melt is allowed to flow into, or is forced into, the mass of reinforcement particles by infiltration. The mixing of particles into a melt and the infiltration of a melt into a packed mass of particles are known fabrication technologies for use in other contexts.

The most preferred bulk-solidifying alloy discussed above has a melting point of about 670° C. In the first of the fabrication procedures, a mass of this matrix alloy in a crucible is heated somewhat above that temperature, preferably to a temperature of from about 700° C. to about 850° C., most preferably to a temperature of about 750° C., in an atmosphere of pure argon. The reinforcement particles are added and dispersed within the melt by stirring. The mixture of molten metal and reinforcement particles, which are not melted, is retained at the melting temperature for a short time of about one minute. The melt is then allowed to cool, causing the molten metal to solidify, numeral 46.

In the infiltration approach, a mass of the reinforcement particles is placed into a container such as a metal or ceramic tube. The tube and particles are heated to the infiltration temperature, in the preferred case preferably to a temperature of from about 700° C. to about 850° C., most preferably to a temperature of about 750° C., in an atmosphere of pure argon. The matrix material is heated to this same temperature and allowed to flow into the mass of reinforcement particles, or, alternatively, forced into the mass of reinforcement particles under pressure. The particles and metal are then allowed to cool, causing the molten metal to solidify, numeral 45.

The mixture is cooled at a sufficiently high solidification rate to cause the molten metal to remain in the,amorphous state, but not greater than about 500° C. per second, to produce a composite material. If higher coo ling rates are needed and used, it is difficult to obtain sufficiently thick pieces for most applications. When the method is practiced properly, the resulting structure is like that depicted in FIG. 1, with reinforcement particles 22 dispersed throughout a substantially completely amorphous metal-matrix phase 24. A minor degree of crystallization is sometimes noted around the reinforcement particles, which are thought to induce such crystallization. Such a minor degree of crystallization is acceptable within the context of the limitation of a substantially completely amorphous metal-matrix phase.

The process steps 40, 42, 44, and 46 are sufficient to perform one embodiment of the method of the invention. In another embodiment, the mixture may be cooled at any cooling rate in step 46, without regard to whether the structure of the solid metal is amorphous. The solidified mixture is thereafter heated to remelt the mixture, numeral 48. The mixture is solidified, numeral 50, by cooling it at a cooling rate sufficiently high that the amorphous state of the metallic alloy is retained, but in no event at a rate greater than about 500° C. per second. This latter embodiment employing steps 40, 42, 44, 46, 48, and 50 may be used, for example, in remelt operations wherein an ingot of the composite material is prepared at a central location and provided to users who remelt and recast the composite material into desired shapes.

The following examples illustrate aspects of the invention, but should not be taken as limiting the invention in any respect.

EXAMPLE 1

A quantity of titanium carbide (TIC), having a size of 100–120 mesh, was infiltrated with molten metal of the preferred composition discussed previously. Infiltration was accomplished in an atmosphere of clean, gettered argon at a temperature of about 750° C. The metal wetted the TiC particles well, and the resulting mass was cooled to ambient temperature at a rate of from about 10° C. to about 120° C. per second. The time of contact between the TiC and the molten metal at the infiltration temperature was less than one minute. The mixture of titanium carbide and metallic alloy was reheated to a temperature of about 900° C. for about two minutes and cooled to ambient temperature at a rate of from about 10° C. to about 120° C. per second. Microscopic examination revealed that the TiC was well wetted and that the matrix was amorphous with substantially no crystallization present.

EXAMPLE 2

Example 1 was repeated, using silicon carbide particulate having a size of −80+120 mesh. The results were substantially the same.

EXAMPLE 3

Example 1 was repeated, using tungsten carbide particulate having a size of −80+120 mesh. The results were substantially the same.

EXAMPLE 4

Example 1 was repeated, using alumina particulate having a size of −120+325 mesh. The results were substantially the same.

EXAMPLE 5

Example 1 was repeated, using cubic boron nitride particulate having a size of −100+120 mesh. The results were substantially the same.

EXAMPLE 6

The sizes of indenter impressions of specimens of the composite material produced in Examples 1–5 and the matrix alloy were measured using a conical diamond indenter with a 60 kilogram load in a Rockwell type hardness testing machine. The results are as follows, with the impression size indicated in micrometers: Example 1, 380; Example 2, 340, Example 3, 290; Example 4, 330; Example 5, 350; matrix alloy alone, 720. These hardness measurements demonstrate that the presence of the particles increases the strength of the composite material above that of the matrix alloy alone, inasmuch as the strength generally varies inversely with the square of the diameter of the impression.

EXAMPLE 7

A quantity of intermeshed silicon carbide fibers, each fiber being about 25 micrometers in diameter and ½ inch long, was infiltrated with molten metal of the preferred composition. Infiltration was accomplished in an atmosphere of clean, gettered argon at a temperature of about 800° C. The metal wetted the fibrous silicon carbide sufficiently well to show spreading of the liquid alloy, and the resulting mass was cooled to ambient temperature at a rate of from about 10° C. to about 120° C. per second. The time of contact between the silicon carbide and the molten metal at the infiltration temperature was about two minutes. Microscopic examination of the composite material demonstrated that the matrix alloy had not crystallized.

The present invention provides an approach for preparing a hard, abrasive composite material useful as a cutting tool or as a wear-resistant structure. The reinforcement material embedded in the matrix provides the primary cutting and wear-resistance function. The amorphous matrix effectively bonds the reinforcement, and is itself a relatively hard, tough, abrasion-resistant material. Thus, the matrix does not readily wear away or crack during service, resulting in pull-out of the reinforcement particles from the wearing surface. The amorphous matrix material and the composite structure itself impart fracture resistance to the composite material, another important attribute for cutting tools, abrasion-resistant surfaces, and similar articles.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of forming a reinforcement-containing metal-matrix composite material, comprising the steps of:

providing a metal having a capability of retaining the amorphous state when cooled from its melt at a critical cooling rate of no more than about 500° C. per second;

providing at least one piece of reinforcement material, separate from the metal;

melting the metal and dispersing the at least one piece of reinforcement material throughout the melt to form a mixture; and solidifying the mixture at a cooling rate no less than the critical cooling rate.

2. The method of claim 1, wherein the step of providing includes the step of providing a reinforcement material selected from the group consisting of a stable oxide, a stable carbide, and a stable nitride.

3. The method of claim 1, wherein the step of providing a metal includes the step of providing a metal having a composition of about that of a eutectic composition.

4. The method of claim 1, wherein the step of providing a metal includes the step of providing a metal having a composition, in atom percent, of from about 45 to about 67 percent total of zirconium plus titanium, from about 10 to about 35 percent beryllium, and from about 10 to about 38 percent total of copper plus nickel.

5. The method of claim 1, wherein the step of providing at least one piece of reinforcement material includes the step of providing a plurality of pieces of reinforcement material.

6. The method of claim 5, wherein the step of providing a plurality of pieces of reinforcement material includes the step of providing a plurality of pieces of reinforcement material having a size of from about 20 mesh to about 160 mesh.

7. The method of claim 1, wherein the step of melting the metal and dispersing the at least one piece of reinforcement material throughout the melt includes the steps of:

preparing a mass of molten metal in a crucible, and mixing the at least one piece of reinforcement material into the mass of molten metal.

8. The method of claim 5, wherein the step of melting the metal and dispersing the at least one piece of reinforcement material throughout the melt includes the steps of:

preparing a mass of pieces of the reinforcement material, melting the metal, and infiltrating the melted metal into the mass of pieces of the reinforcement material.

9. A method of forming a reinforcement-containing metal-matrix composite material, comprising the steps of:

providing a plurality of pieces of reinforcement material;

providing a metal capable of retaining the amorphous state when cooled from its melt at a critical cooling rate of no more than about 500° C. per second and which has a composition of about that of a eutectic composition;

melting the metal and dispersing the pieces of reinforcement material in the melt to form a mixture;

solidifying the mixture at a rate no higher than about 500° C. per second.

10. The method of claim 9, wherein the step of providing includes the step of providing a reinforcement material selected from the group consisting of a stable oxide, a stable carbide, and a stable nitride.

11. The method of claim 9, wherein the step of providing a metal includes the step of providing a metal having a composition, in atom percent, of from about 45 to about 67 percent total of zirconium plus titanium, from about 10 to about 35 percent beryllium, and from about 10 to about 38 percent total of copper plus nickel.

12. The method of claim 9, wherein the step of melting the metal and dispersing the pieces of reinforcement material throughout the melt to form a mixture includes the steps of:

preparing a mass of molten metal in a crucible, and mixing the at least one piece of reinforcement material into the mass of molten metal.

13. The method of claim 9, wherein the step of melting the metal and dispersing the pieces of reinforcement material throughout the melt to form a mixture includes the steps of:

preparing a mass of pieces of the reinforcement material, melting the metal, and infiltrating the melted metal into the mass of pieces of the reinforcement material.

* * * * *